US007186056B2

(12) United States Patent
Magee

(10) Patent No.: US 7,186,056 B2
(45) Date of Patent: Mar. 6, 2007

(54) SPLIT DRUM AND SUPPORT ARRANGEMENT FOR A COMPACTING WORK MACHINE

(75) Inventor: Kevin J. Magee, Buffalo, MN (US)

(73) Assignee: Caterpillar Paving Products Inc, Minneapolis, MN (US)

( * ) Notice: Subject to any disclaimer, the term of this patent is extended or adjusted under 35 U.S.C. 154(b) by 0 days.

(21) Appl. No.: 10/918,059

(22) Filed: Aug. 13, 2004

(65) Prior Publication Data

US 2006/0034659 A1 Feb. 16, 2006

(51) Int. Cl.
*E01C 19/38* (2006.01)

(52) U.S. Cl. ..... 404/117; 404/128

(58) Field of Classification Search ..... 404/122, 404/132, 128, 117; 180/247–250, 341, 371; 74/61, 87

See application file for complete search history.

(56) References Cited

U.S. PATENT DOCUMENTS 4,632,599 A * 12/1986 Sadahiro ..... 404/124
5,390,495 A 2/1995 Lemaire
5,397,198 A * 3/1995 Bertrand ..... 404/117
5,716,162 A 2/1998 Hodgson et al.
6,402,424 B2 6/2002 Mitsui
6,561,729 B1 5/2003 Potts
6,829,986 B2 * 12/2004 Richter ..... 100/155 R
6,837,650 B2 * 1/2005 Magee et al. ..... 404/132

OTHER PUBLICATIONS

HAMM, DV6, Operating and Service Manual, Edition 04 83, HAMM Walzenfabrik GmbH.

* cited by examiner

*Primary Examiner*—Gary S. Hartmann
(74) *Attorney, Agent, or Firm*—Kevin C. Earle

(57) ABSTRACT

A split drum is provided for a compacting work machine and includes a first and a second drum section. A support arrangement defines a housing that surrounds a vibratory mechanism and is adapted to support the first and second drum sections. The support arrangement comprises a first support member and a second support member that are rotatably connected. Rotational power may be supplied to the first and second drum sections through the use of a propel motor. The first and second drum sections may be rotated at equal speeds or different speeds relative to one another.

9 Claims, 2 Drawing Sheets

SPLIT DRUM AND SUPPORT ARRANGEMENT FOR A COMPACTING WORK MACHINE

TECHNICAL FIELD

The invention relates generally to asphalt and soil compacting work machines, and more particularly to a support arrangement adapted to support a split drum for such work machines.

BACKGROUND

Compacting work machines are commonly employed for compacting freshly laid asphalt, soil, and other compactable substrates. For example these work machines may include plate type compactors or rolling drum compactors with one or more drums. The drum type work machines function to compact the material over which the machine is driven. In order to more efficiently compact the material the drum assembly often includes a vibratory mechanism for inducing vibratory forces on the material being compacted.

It is common practice in the compacting of asphalt to use work machines that include two rotating drums to more efficiently compact the material. Double drum compactors are used so that during each pass over the material being compacted each drum performs a portion of the compacting process. These double drum compactors either have an articulating frame or each drum has the ability to pivot about a vertical axis so that the work machine can be steered in a desired direction during operation. During tight turning operations the portion of the drum that is radially outward of the turn can slide over the material being compacted. This sliding can cause a tear in the material because the portion of the drum that is radially outward of the turn desires to rotate faster than the inner portion. On the other hand the inner portion of the drum can plow or mound the asphalt because the tendency is for the inner portion of the drum to rotate slower than the outside portion. Both of the above-described tendencies are contrary to the goal of finishing a road surface that is smooth and flat.

A solution in an attempt to minimize the problem set forth above is to provide a drum that has first and second drum sections known as a split drum. The split drum divides the width of a given drum in half allowing an outer drum section to rotate faster than an inner drum section during turning operations. Split drum designs are known in the art and often use a fixed friction pack to couple the two drum sections to one another, such as seen in a Hamm Operating and Service Manual (DV-6, Edition 04 83). This reference teaches having an offset support arrangement wherein the friction pack is offset to one side and the vibratory mechanism is offset to the other side. This imbalance in the drum and results in poor compacting on one side and not the other. Additionally, the frictional force of the friction packs must be overcome however before slip can occur between the drum sections. In operation however these split drums do not always operate in a predictable manner and slip between the sections occurs when not desired and often does not occur when slip is desired. Another attempt to address this problem is disclosed in U.S. Pat. No. 5,390,495 granted on Feb. 21, 1995 and assigned to Poclain Hydraulics. This patent teaches having first and second drum sections that are coupled together by a brake arrangement and using independent drive motors to propel each drum section.

The present invention is directed at overcoming one or more of the problems as set forth above.

SUMMARY OF THE INVENTION

In one aspect of the present invention, a support arrangement adapted to support a split drum of a compacting machine is provided. The support arrangement includes a first support member and a second support member rotatably connected to each other. The support arrangement defines a housing that surrounds a vibratory mechanism of the split drum.

In yet another aspect of the present invention, a split drum rotatably supporting a main frame of a compacting work machine is provided. The split drum includes a first drum section, a second drum section, a housing and a vibratory mechanism. The housing is defined by a support arrangement and surrounds a vibratory mechanism of the split drum. The support arrangement rotatably supports the first drum section and the second drum section.

DETAILED DESCRIPTION

Figure 1:
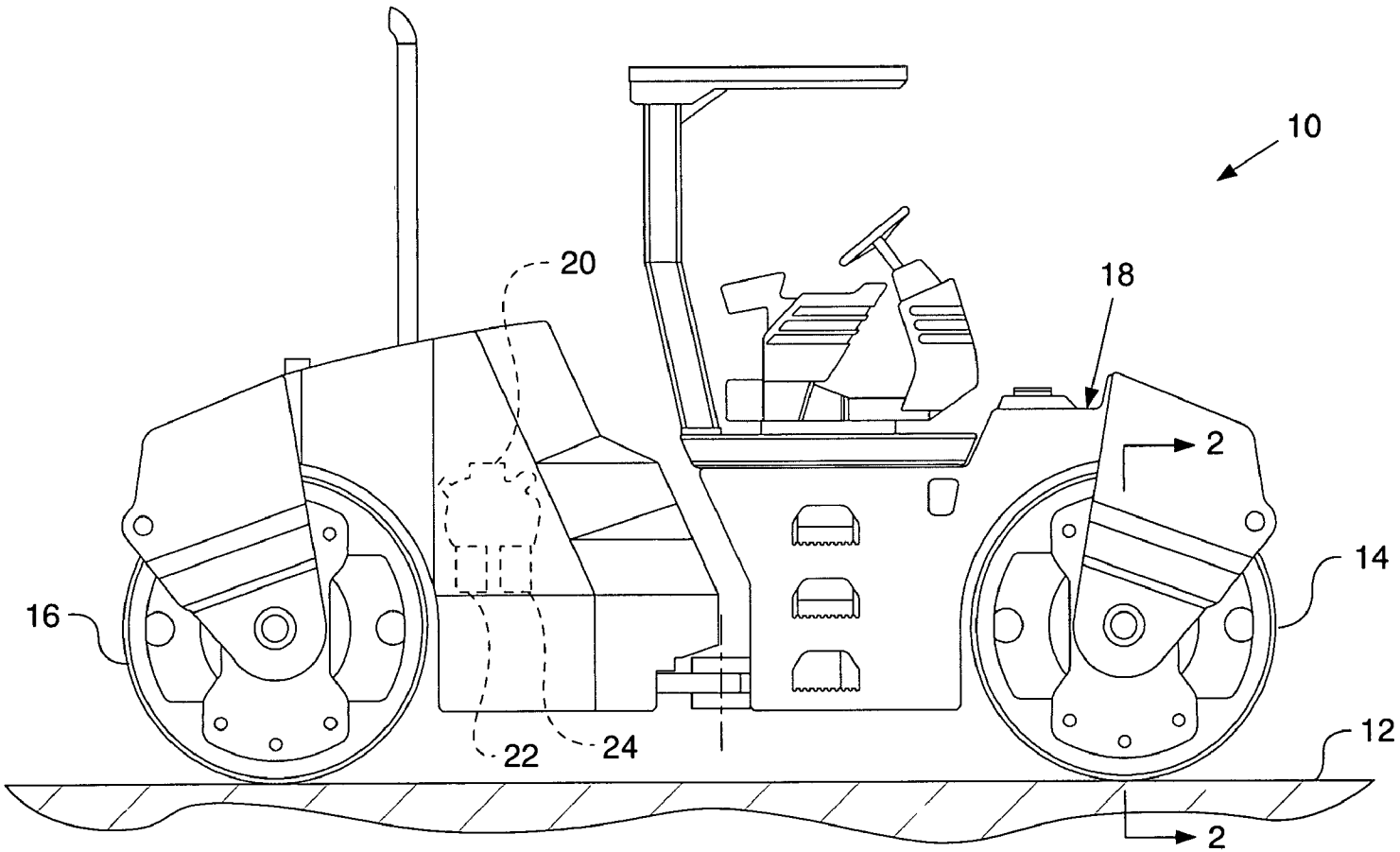
FIG. 1 is a side elevational view of a work machine embodying the present disclosure.

A work machine 10, for increasing the density of a compactable material or mat 12 such as soil, gravel, or bituminous mixtures is shown in FIG. 1. The work machine 10 is for example, a double drum vibratory compactor, having a first/front compacting drum 14 and a second/rear compacting drum 16 rotatably mounted on a main frame 18. The main frame 18 also supports an engine 20 that has at least one power source 22,24 conventionally connected thereto. Variable displacement fluid pumps or electrical generators can be used as interchangeable alternatives for power sources 22,24 without departing from the present invention.

Figure 2:
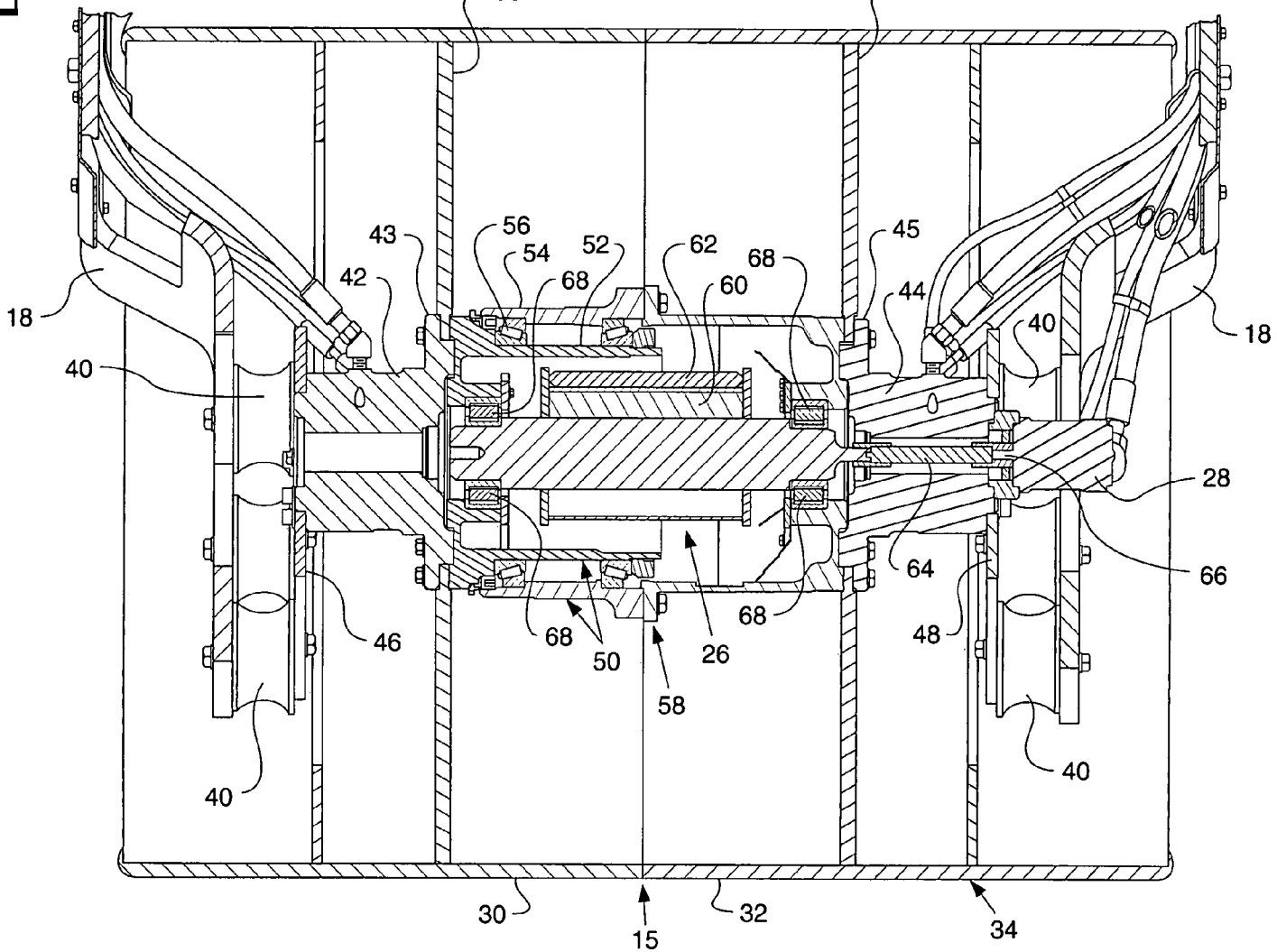
FIG. 2 shows an axial cross section view taken along line 2—2 through a compacting drum of the work machine of FIG. 1, showing an embodiment of the present disclosure.

In as much as, the front drum 14 and the rear drum 16 are structurally and operatively similar. The description, construction and elements comprising the front drum 14 will now be discussed in detail and applies equally to the rear drum 16. Referring to FIG. 2, the front drum 14 includes a vibratory mechanism 26 that is operatively connected to a vibratory motor 28. The vibratory motor 28 is operatively connected, as by fluid conduits and control valves or electrical conductors and switches neither of which are shown, to the power source 22, 24.

The front drum 14 is a split drum 15 that includes a first and a second drum section 30,32. Each of the first and second drum sections 30,32 is made up of an outer shell 34 that is manufactured from a steel plate that is rolled and welded at the joining seam. A first bulkhead 36 is fixedly secured to the inside diameter of the outer shell 34 of the first drum section 30 as by welding and a second bulkhead 38 is fixedly secured to the inside diameter of the outer shell 34 of the second drum section 32 in the same manner.

The first and second drum sections 30,32 are vibrationally isolated from the main frame 18 by rubber mounts 40. A first propel motor 42 is positioned between the main frame 18 and the first drum section 30. For example, the first propel motor 42 is connected to a first mounting plate 46 and an output of the first propel motor 43 is connected to the first bulkhead 36 and a first support member 52, by fasteners. The rubber mounts 40 are positioned between and connected to the main frame 18 and the first mounting plate 46. The first propel motor 42 additionally is operatively connected to the power source 22, 24 which, supplies a pressurized operation fluid or electrical current, to first propel motor 42 for propelling the first drum section 30.

In a similar manner, a second propel motor 44 is positioned between the main frame 18 and the second drum section 32. Rubber mounts 40 are positioned between and connected to the main frame 18 and the second mounting plate 48. The second propel motor 44 is connected to the second mounting plate 48 and an output of the second propel motor 45 is connected to the second bulkhead 38 and a second support member 54, by fasteners, the second support member, in this embodiment, being made of two pieces. The second propel motor 44 additionally is operatively connected to the power source 22, 24 which, supplies a pressurized operation fluid or electrical current, to second propel motor 44 for propelling the second drum section 32.

The vibratory mechanism 26 includes a first/inner eccentric weight 60 and a second/outer eccentric weight 62 that are connected to a vibratory mechanism shaft 64. The first/inner eccentric weight 60, being a movable weight, and the second/outer eccentric weight 62, being a stationary weight, are rotatably supported within a housing 58 by bearings 68. The vibratory motor 28, when driven in a first direction, supplies a rotational power to the vibratory mechanism 26 thereby imparting a vibratory force, having a first amplitude, on compacting drum 14. When the vibratory 28 is driven in an opposite direction to supply rotational power to the vibratory mechanism 26, a vibratory force having a second amplitude is imparted on the compacting drum 14. The amplitude of the vibratory mechanism 26 may be set manually, having two or more amplitude settings, or automatically, having an infinitely variable amplitude, depending on the type of vibratory mechanism 26 being used.

About the vibratory mechanism is a support arrangement 50 which is part of a housing 58 that rotatably connects the first drum section 30 to the second drum section 32. The support arrangement 50 is rotatably connected between the first and second bulkheads 36, 38 to enable the first and second drum section 30, 32 to rotate in relation to one another. As mentioned above, the first support member 52 is connected to the first bulkhead 36 and the output of the first propel motor 43 by fasteners. The second support member 54, being made up of two separate pieces connected by fasteners, is connected to the second bulkhead 38 and the output of the second propel motor 45 by fasteners. Although the second support member 54 as shown in this embodiment is made of two separate pieces, it may also be one complete piece. The first support member 52 is rotatably positioned inside the second support member 54 and rotatably connected by a bearing arrangement. In this case, the bearing arrangement consists of tapered roller bearings 56. The support arrangement 50 allows the first propel motor 42 to rotate the first drum section 30 about the vibration mechanism 26 at either the same rate or at a different rate than the second propel motor 44 rotates the second drum section 32 about the vibration mechanism 26.

Of course, this is but one of a number of arrangements that the support arrangement 50 may assume. For example, the second support member 54 may be rotatably positioned outside the first support member 52. The first support member 52 may also be rotatably positioned outside the second support member 54. Another example may have the first and second support members 52, 54 come together at the bearing arrangement where they may be rotatably connected without any overlap of the first and second support members 52, 54. Additionally, the bearing arrangement that may be seen in any of the embodiments may comprise, but is not limited to, tapered roller bearings, ball bearings, and bronze bushings.

In an alternative embodiment of the present disclosure (not shown), the first and second drum sections 30, 32 may be rotatably connected by a support arrangement 50 and a one of the first and second drum sections 30, 32 may be rotatably driven by a single propel motor. The other of the first and second drum sections 30, 32 may be rotatably controllable by a brake mechanism (not shown). The brake mechanism may comprise, but is not limited to, a caliper and disc brake arrangement capable of locking the first drum section 30 to the second drum section 32. The brake mechanism may also allow the first drum section 30 to rotate at a different rate than the second drum section 32. In one embodiment, the caliper (not shown) could be attached to the inside diameter of the first drum section 30 and the associated disc (not shown) could be attached to the housing 58 and extend sufficiently outward toward the inner diameter of the second drum section 32 such that the caliper is operable to engage the disc.

INDUSTRIAL APPLICABILITY

In operation rotational/propel power is supplied to the first/front drum 14 by the first and second propel motors 42, 44. Power from the first and second propel motors 42, 44 is transmitted through the first and second support members 52, 54 of the support arrangement 50. The support arrangement 50 is used to support the relative movement between the first and second drum sections 30,32. The support arrangement 50 creates a rigid joint between the first and second drum sections 30, 32 such that the first and second drum sections 30, 32 are free to rotate at equal or different speeds as may be demanded during operation of the compactor so the drums do not tear the compacting material 12 during tight turning operations.

In alternate embodiments of the present disclosure, such as when a single propel motor is used in conjunction with a brake mechanism (not shown), the first or second drum section 30, 32 will be locked to the other of the first or second drums section 30, 32 as the brake mechanism is engaged such that the single propel motor will cause the first and second drum sections 30, 32 to rotate at an equal rate. When the brake mechanism is disengaged, one of the first and second drum sections 30, 32 will be allowed to rotate faster or slower than the other of the first and second drum section 30, 32 during tight turning operations.

The split drum 15 provided offers an effective means of overcoming the undesirable characteristics of known unitary drum configurations. In addition to providing an improved support arrangement 50, the vibratory mechanism efficiency may also be improved through reduction in weight by only requiring one vibratory mechanism. Centering of the vibratory mechanism with this support arrangement 50 will help balance the first and second drum sections 30, 32 such that compaction of the compactable material 12 is equal. Furthermore, loading and sealing of the support arrangement 50 has been improved over prior support arrangements with the separation of the bearing arrangement with the first and second support members 52, 54. The support arrangement 50 may be further improved by widening the first and second support members 52, 54 and spreading out the bearing arrangement even farther about the vibratory mechanism 26.

It will be apparent to those skilled in the art that various modifications and variations can be made in the system and method of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A split drum rotatably supporting a main frame of a compacting work machine, said split drum comprising:

a first drum section;

a second drum section;

a first support member fixedly connected to said first drum section;

a second support member fixedly connected to said second drum section;

a vibratory mechanism housed within said first and second support members; and a bearing arrangement rotatably separating said first and second support members.

2. The split drum as set forth in claim 1, wherein said first support member is operably connected to a first bulkhead of said first drum section and said second support member is operably connected to a second bulkhead of said second drum section.

3. The split drum as set forth in claim 1, wherein a one of said first support member and said second support member is rotatably positioned inside the other of said first support member and said second support member.

4. The split drum as set forth in claim 1, wherein a propel motor rotatably drives said first drum section.

5. The split drum as set forth in claim 4, wherein a first propel motor rotatably drives one of said first and second drum sections and a second propel motor rotatably drives the other of said first and second drum sections.

6. The split drum as set forth in claim 5, wherein said first and second drum sections are operable to allow said first drum section to rotate at a different rate than said second drum section.

7. The split drum as set forth in claim 1, wherein said bearing arrangement includes at least one tapered roller bearing.

8. The split drum as set forth in claim 3, wherein said bearing arrangement includes at least one tapered roller bearing.

9. The split drum as set forth in claim 6, wherein said bearing arrangement includes at least one tapered roller bearing.

* * * * *